US009183800B2

(12) United States Patent
Fu et al.

(10) Patent No.: US 9,183,800 B2
(45) Date of Patent: Nov. 10, 2015

(54) LIQUID CRYSTAL DEVICE AND THE DRIVEN METHOD THEREOF

(71) Applicant: Shenzhen China Star Optoelectronics Technology Co., Ltd., Shenzhen, Guangdong (CN)

(72) Inventors: Wei Fu, Shenzhen (CN); Yu Wu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 150 days.

(21) Appl. No.: 14/007,327

(22) PCT Filed: Jul. 25, 2013

(86) PCT No.: PCT/CN2013/080107
§ 371 (c)(1),
(2) Date: Sep. 24, 2013

(87) PCT Pub. No.: WO2015/010298
PCT Pub. Date: Jan. 29, 2015

(65) Prior Publication Data

US 2015/0022560 A1 Jan. 22, 2015

(30) Foreign Application Priority Data

Jul. 22, 2013 (CN) ..... 2013 1 0309704

(51) Int. Cl.
*G09G 5/10* (2006.01)
*G09G 3/36* (2006.01)

(52) U.S. Cl.
CPC ..... *G09G 3/3614* (2013.01); *G09G 2330/021* (2013.01); *G09G 2340/16* (2013.01)

(58) Field of Classification Search
CPC ..... G09G 3/3614; G09G 2330/021; G09G 2340/16
USPC ..... 345/89, 102, 173, 209–212, 690; 715/765; 355/67
See application file for complete search history.

(56) References Cited

U.S. PATENT DOCUMENTS 4,849,746 A * 7/1989 Dubner ..... 345/685
6,930,759 B2 * 8/2005 Roddy et al. ..... 355/67
(Continued)

FOREIGN PATENT DOCUMENTS

CN 101436391 A 5/2009
CN 102237058 A 11/2011

OTHER PUBLICATIONS

Translation CN201010174257.*

*Primary Examiner* — Prabodh M Dharia
(74) *Attorney, Agent, or Firm* — Andrew C. Cheng

(57) ABSTRACT

A liquid crystal device (LCD) and a driving method thereof are disclosed. The LCD includes a display panel, a data driven circuit configured for providing data voltages to the data lines, and a power reducing module. The display panel includes data lines, scanning lines intersecting with the data lines, and a matrix of pixels arranged in intersections of rows and columns. The power reducing module is configured for storing a most-reload-image, comparing the data of the most-reload-image and the data of an input image, determining if the input image is a reload image increasing a power consumption of the data driven circuit, and changing a polarity inversion method of a timing controller. By changing the polarity inversion method of the timing controller basing on the input images, the display performance is guaranteed and the power consumption of the data driven circuit is reduced at the same time.

17 Claims, 4 Drawing Sheets

(56) References Cited

U.S. PATENT DOCUMENTS

| | | | | |
|---|---|---|---|---|
| 2002/0027541 | A1* | 3/2002 | Cairns et al. | 345/87 |
| 2002/0149598 | A1* | 10/2002 | Greier et al. | 345/589 |
| 2009/0033602 | A1* | 2/2009 | Alexander et al. | 345/77 |
| 2010/0020057 | A1* | 1/2010 | Shin et al. | 345/211 |
| 2010/0103089 | A1* | 4/2010 | Yoshida et al. | 345/102 |
| 2011/0134088 | A1* | 6/2011 | Chen et al. | 345/204 |
| 2011/0285683 | A1* | 11/2011 | Todorovich et al. | 345/208 |
| 2012/0001881 | A1* | 1/2012 | Miyake et al. | 345/209 |
| 2012/0098848 | A1* | 4/2012 | Choi et al. | 345/589 |
| 2013/0021229 | A1* | 1/2013 | Ludden et al. | 345/89 |
| 2013/0088528 | A1* | 4/2013 | Borgers et al. | 345/690 |
| 2013/0159902 | A1* | 6/2013 | Kwak et al. | 715/765 |
| 2013/0215096 | A1* | 8/2013 | Kim | 345/212 |
| 2014/0267445 | A1* | 9/2014 | Yaras et al. | 345/690 |
| 2014/0313236 | A1* | 10/2014 | Jang et al. | 345/690 |
| 2014/0340330 | A1* | 11/2014 | Trachtenberg et al. | 345/173 |
| 2015/0070340 | A1* | 3/2015 | Trachtenberg et al. | 345/211 |

* cited by examiner

LIQUID CRYSTAL DEVICE AND THE DRIVEN METHOD THEREOF

BACKGROUND OF THE INVENTION

1. Field of the Invention

The present disclosure relates to liquid crystal display technology, and more particularly to a liquid crystal device and the driven method thereof for reducing the power consumption of the data driven circuit.

2. Discussion of the Related Art

Liquid crystal devices (LCDs) typically are driven by a passive matrix method or an active matrix method. Regarding the active matrix LCDs, a plurality of pixels are arranged in a matrix form. The pixels are incapable of emitting lights and thus the thin film transistors (TFTs) within the pixels are needed such that the TFTs can be turn on or off to provide appropriate data voltages to the liquid crystal within the pixels. In addition, the TFTs cooperatively operate with backlight sources such that the LCD can display images.

Each of the pixels in the active matrix LCD is driven by polarity inversion method. That is, the data voltage generated from the polarity inversion is applied to the liquid crystals in each of the pixels. However, the adjacent pixels arranged in the pixel matrix have to be driven by the same polarity. Generally, the polarity inversion method includes frame inversion, column inversion, row inversion and dot inversion. During the period after the current frame has been inputted completely and before the current frame is inputted, the frame inversion relates to that the polarity stored in the pixels of the frame is the same (all positive or all negative). The column inversion relates to that the polarity of the pixels on one column is the same and the polarity of the pixels on the adjacent columns are inversed. The row inversion relates to that the polarity of the pixels on the same row is the same and the polarity of the pixels on the adjacent rows are inversed. The dot inversion relates to that the polarity of each of the pixel is inversed to the polarity of adjacent pixels.

During the driving process, the polarity of the data voltage is inversed such that the data driven circuit generates heat, which results in a higher temperature. That is, the data driven circuit consumes power. Among the four polarity inversion methods, the frame inversion consumes the lowest power and the display performance is the worst. The dot inversion has the best display performance while the power consumptions is the highest. The power consumption and display performance of the column inversion and the row inversion are better than the average.

To obtain better display performance, generally, the dot inversion is adopted to drive the liquid crystals in the pixels. Not only the power consumption is high, the temperature of the data driven circuit gets higher and higher when reloading the images, and thus the power consumptions is increased.

SUMMARY

The object of the invention is to provide a liquid crystal display with reduced power consumption of the data driven circuit and the driving method thereof.

In one aspect, a liquid crystal display (LCD) includes: a display panel comprising a plurality of data lines, a plurality of scanning lines intersecting with the data lines, and a matrix of pixels arranged in intersections of rows and columns; a data driven circuit configured for providing data voltages to the data lines; and a power reducing module configured for storing a most-reload-image, comparing the data of the most-reload-image and the data of an input image, determining if the input image is a reload image increasing a power consumption of the data driven circuit according to a comparison result, and changing a polarity inversion method of a timing controller according to a determination result.

Wherein when the input image is the reload image, the power reducing module changes the polarity inversion method of the timing controller from a dot inversion to a column inversion, and when the input image is not the reload image, the polarity inversion method of the timing controller is maintained as the dot inversion or changed back to the dot inversion from the column inversion by the power reducing module.

Wherein the power reducing module includes: a memory configured for storing the data of the most-reload-image; a detector configured for comparing the data of the input image and the data of the most-reload-image stored in the memory and determines if the input image is the most-reload-image increasing the power consumption of the data driven circuit according to the comparison result; and a polarity controller configured for changing the polarity inversion method of the timing controller according to the determination result of the detector.

Wherein when the display panel adopts one data line to provide a data voltage to one column of pixels, the most-reload-image is an all-white image or a dot on/off image.

Wherein when the display panel adopts one data line to provide a data voltage to pixels arranged in two adjacent columns, the most-reload-image is an all-white image or a H-strip image.

Wherein the data of the input image includes gray scale values of each of the pixels in the input image, the data of the most-reload-image includes the gray scale values of each of the pixels in the most-reload-image, wherein the gray scale values of each of the pixels in the input image are compared with the gray scale values of each of the pixels in the most-reload-image to obtain a gray level ratio for each of the pixels, and an average ratio is calculated by the obtained gray level ratios for each of the pixels, wherein when the average ratio is larger than or equal to a default ratio, the input image is determined as the reload image, and when the average ratio is smaller than the default ratio, the input image is determined as a normal image.

Wherein the default ratio is in a range between 0.75 and 1.

Wherein when the display panel adopts one data line to provide a data voltage to one column of pixels and the most-reload-image is the dot on/off image, two dot on/off images with inversed polarity are stored in the power reducing module, the data of the input image has to be respectively compared with the data of the two dot on/off images with inversed polarity to obtain two average ratios, the input image is determined as the reload image if any one of the average ratios is not smaller than the default ratio, and wherein in the dot on/off images with inversed polarity, the brightness of one pixel in one of the dot on/off image is opposite to the brightness of the pixel with the same location in the other dot on/off image.

Wherein when the display panel adopts one data line to provide a data voltage to pixels arranged in two adjacent columns and when the most-reload-image is the H-strip image, the data of the input image is respectively compared with two H-strip having inversed polarity to obtain two average ratios, the input image is determined as the reload image if any one of the average ratios is not smaller than the default ratio, and wherein in the two H-strip images with inversed polarity, the brightness of one pixel in one of the dot on/off image is opposite to the brightness of the pixel with the same location in the other dot on/off image.

In another aspect, a driving method of a LCD is disclosed. The LCD includes a display panel and a data driven circuit configured for providing data voltages to the data lines. The display panel includes a plurality of data lines, a plurality of scanning lines intersecting with the data lines, and a matrix of pixels arranged in intersections of rows and columns the driving method includes: (a) comparing the data of an input image and the data of a most-reload-image stored in the power reducing module; (b) determining if the input image is a reload image increasing the power consumption of the data driven circuit according to a comparison result; and (c) changing a polarity inversion method of the timing controller according to a determination result.

In view of the above, by selectively changing the polarity inversion method of the timing controller basing on the input images, the display performance is guaranteed and the power consumption of the data driven circuit is reduced at the same time.

DETAILED DESCRIPTION OF THE EMBODIMENTS

Embodiments of the invention will now be described more fully hereinafter with reference to the accompanying drawings, in which embodiments of the invention are shown.

Figure 1:
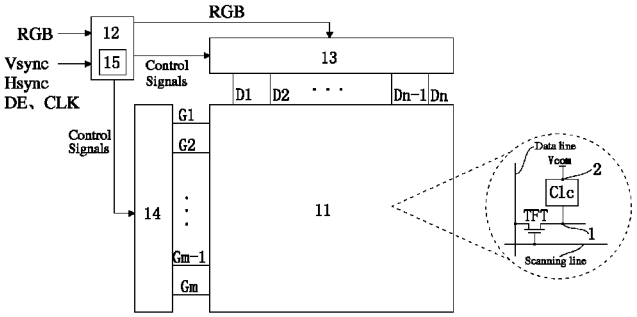
FIG. 1 is a schematic view of the LCD in accordance with one embodiment.

FIG. 1 is a schematic view of the LCD in accordance with one embodiment. The LCD includes a display panel 11, a timing controller 12, a data driven circuit 13, a scanning driven circuit 14, and a power reducing module 15.

The display panel 11 includes an up glass substrate and a down glass substrate bonded together, and liquid crystals provided between the up glass substrate and the down glass substrate. The display panel 11 includes a plurality of data lines (D1 to Dn), a plurality of scanning lines (G1 to Gm) intersecting with the data lines (D1 to Dn), and a (n×m) matrix of pixels arranged in the intersections of rows and columns. The m and n are positive integers.

The (n×m) matrix of pixels is formed on the up glass substrate of the display panel 11. Each of the pixels includes a Thin Film Transistor (TFT), a liquid crystal (Clc), and a pixel electrode 1 arranged in the intersection of the Clc and a source of the TFT. A gate of the TFT connects to the scanning line, and a drain of the TFT connects to the data line.

A black matrix and a color filter (CF) are formed on the up glass substrate of the display panel 11. A common electrode 2 is formed on the up glass substrate by driving methods of vertical electrical field, such as twisted nematic (TN) and vertical alignment (VA). In addition, the common electrode 2 can be formed by driving methods of horizontal electrical field, such as In Plane Switching (IPS) mode or Fringe Field Switching (FFS) mode, on the down glass substrate together with the pixel electrode 1.

Two polarizers with optical axis vertical or parallel to each other are respectively adhered to outside surfaces of the up glass substrate and the down glass substrate of the display panel 11. Internal surfaces of the up glass substrate and the down glass substrate of the display panel 11 contacting with the liquid crystals respectively includes an alignment layer for arranging pretilt angles of the liquid crystals.

The timing controller 12 re-configures digital video data RGB of input images received from a system board (not shown) and then provides the re-configured digital video data RGB to the data driven circuit 13. The timing controller 12 receives clock signals from the system board, such as vertical synchronous signals (Vsync), vertical synchronous signals (Hsync), data enable signals (DE) and clock signals (CLK). Also, the timing controller 12 generates the control signals from the clock signals. The control signals are for controlling operational clocks of the data driven circuit 13 and the scanning driven circuit 14.

When being controlled by the timing controller 12, the data driven circuit 13 stores the digital video data RGB and then converts the stored digital video data RGB to generate positive data voltage and negative data voltage.

The data driven circuit 13 provides positive data voltages and negative data voltages to data lines (D1 to Dn). The scanning driven circuit 14 sequentially provides a width scanning pulse having one horizontal period, which is about one frame, to the scanning lines (G1 to Gm) when being controlled by the timing controller 12. For example, when the positive voltage applied to one scanning line is large enough, the gate of all of the TFTs connected to the scanning line are turn on. At this moment, the pixel electrodes of the scanning line connect to the data lines (D1 to Dn) and are then charged by data voltages from the data lines (D1 to Dn) until the voltage is appropriate. Afterward, a negative voltage that is large enough is applied to the scanning line to turn on all of the gate of the TFTs connected to the scanning line. Charges are stored in the liquid crystals (Clc) until the TFTs are turn on next time. At this moment, the next scanning line is turn on to charge the pixel electrodes on the next scanning line. In this way, the video data of the whole image is input in turn, and then the same process repeats from the first scanning line. The repeated frequency is the reciprocal of the time period of one frame.

In the displaying process of LCD, each pixels has to be driven by a polarity inversion method. That is, the data voltage of inversed polarity is applied to the liquid crystal (Clc) of each pixels. To obtain better display performance, the default polarity inversion method of the timing controller 12 is dot inversion. The power reducing module 15 may change the polarity inversion method of the timing controller 12 basing on the input images. For example, the polarity inversion method may be column or frame inversion. Though the power consumption of the data driven circuit 13 is basically the same for column inversion or frame inversion, the display performance of the LCD is better when the polarity inversion method is column inversion. Thus, in the embodiment, the power reducing module 15 selectively changes the polarity inversion method of the timing controller 12 from the dot inversion to column inversion basing on the input images. For example, when the input image is the reload image, the power reducing module 15 changes the polarity inversion method from the dot inversion to the column inversion. On the other hand, when the input image is the normal image, the polarity inversion method of the timing controller is maintained as the dot inversion or changed back to the dot inversion from the column inversion by the power reducing module.

Figure 2A:
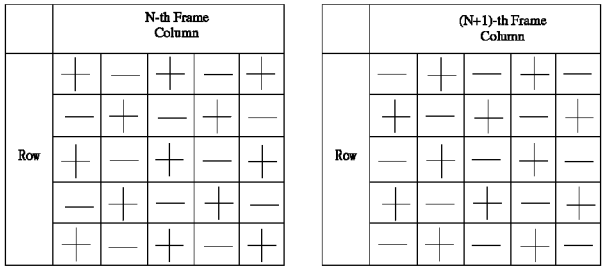
FIG. 2*a* is a schematic view of the dot inversion in accordance with one embodiment.
Figure 2B:
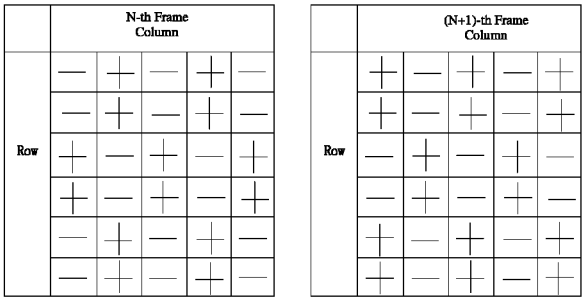
FIG. 2*b* is a schematic view of the dot inversion in accordance with another embodiment.
Figure 3A:
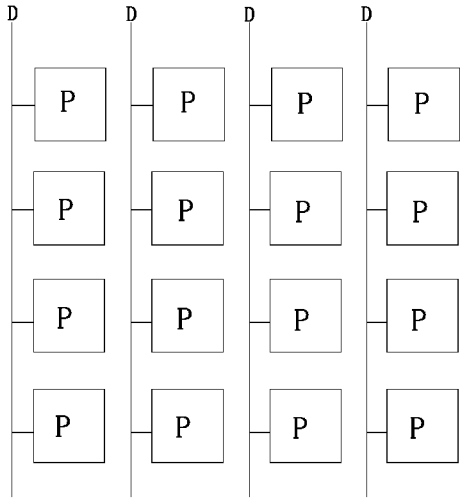
FIG. 3*a* is a schematic view of the pixels charged by the data lines having normal structure in accordance with one embodiment.
Figure 3B:
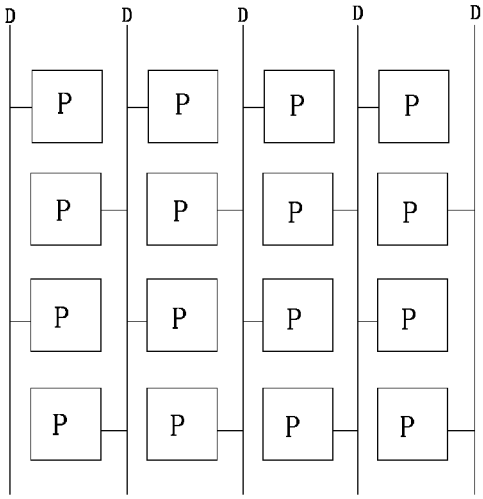
FIG. 3*b* is a schematic view of the pixels charged by the data lines having flip structure in accordance with one embodiment.

It is to be noted that the dot inversion can be implemented in two ways, including the dot inversion and a two line inversion. FIG. 2*a* shows the stored polarity of each of the pixels during the period after the N-th frame has been inputted completely and before the (N+1)-th frame is inputted when the dot inversion is adopted. As shown, the stored polarity of each of the pixels is inversed to the stored polarity of the adjacent pixels. FIG. 2*b* shows the stored polarity of each of the pixels during the period after the N-th frame has been inputted completely and before the (N+1)-th frame is inputted when the two line inversion is adopted. As shown, the stored polarity of the pixels arranged in the N-th row is inversed to that of the pixels arranged in the (N+2)-th row. In addition, the stored polarity of one specific pixel is inversed to that of the pixels arranged to the specific pixel in the row direction. The pixels (P) are charged by data lines (D) having normal structure regardless, i.e., one column of pixels connects to one data line as shown in FIG. 3*a*, or charged by data lines having flip structure, i.e., one column of pixels connects to data lines (D) adjacent to the column of pixels in an interleaved manner as shown in FIG. 3*b* regardless of the dot inversion or two line inversion.

Figure 4:
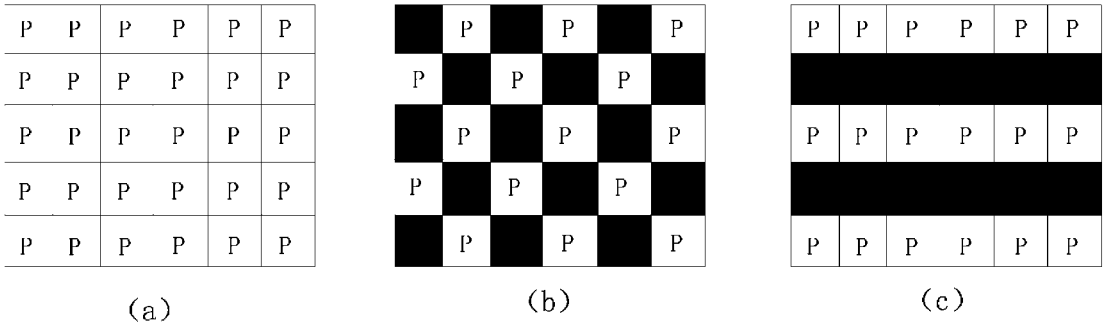
FIG. 4 is a schematic view of most-reload-images when different dot inversion methods are adopted and the pixels are charged by data lines having different structures in accordance with one embodiment.

Each of the images displayed by the display panel 11 includes a plurality of pixels. Each pixel includes its own gray scale information, which is represented by binary code. In the embodiment, there are 256 linear gray scale for each of the pixels, which can be represented by 8 bits. That is, the gray scale value ranges from 0 (darkest brightness) to 255 (brightest brightness). For example, when the pixels are charged by data lines having normal structure and the polarity inversion method is dot inversion, a most-reload-image relates to an all-white image, and the brightness of all of the pixels are at a maximum level, which is indicated by "P" in FIG. 4*a*. When the polarity inversion method is two line inversion, the most-reload-image relates to an dot on/off image as shown in FIG. 4*b*. That is, the brightness of each of the pixel is different from that of all of the adjacent pixels. For example, when the brightness of a specific pixel is at the maximum level, which is indicated by "P" in FIG. 4*b*, the brightness of the pixels adjacent to the specific pixel are at a minimum level. However, when the pixels are charged by data lines having flip structure and the dot inversion is adopted, the most-reload-image relates to the all-white image as shown in FIG. 4*a*. When the two line inversion is adopted, the most-reload-image relates to a H-strip image as shown in FIG. 4*c*. That is, the brightness of one specific row of pixels is different from that of pixels arranged in the rows adjacent to the specific row. For example, when the brightness of the pixels arranged in one specific row is at the maximum level, which is indicated by "P" in FIG. 4*c*, the brightness of the pixels arranged in rows adjacent to the specific row is at the minimum level. The most-reload-image has a corresponding gray level value. For example, the gray level value of the all-white image is 255.

Figure 5:
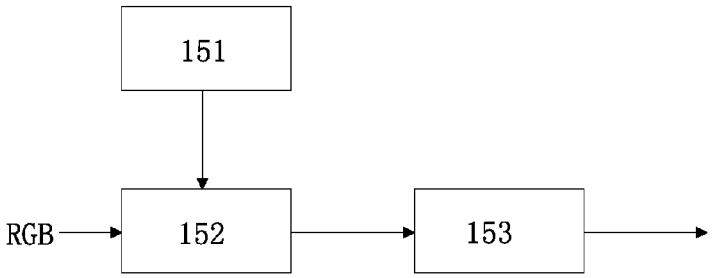
FIG. 5 is a schematic view of the power reducing module of FIG. 1.

FIG. 5 is a schematic view of the power reducing module of FIG. 1. As shown, the power reducing module 15 includes a memory 151, a detector 152, and a polarity controller 153. The power reducing module 15 may be installed within the timing controller 12.

The determined most-reload-image is stored in the memory 151 according to the structure of the data lines and the dot inversion method. For example, when the dot inversion is adopted and the data line is of the normal structure, the most-reload-image is the all-white image. Thus, the data of the all-white image is stored in the memory 151. It is to be noted that when the most-reload-image is the dot on/off image, two dot on/off images with inversed polarity are stored in the memory 151. For example, when the brightness of one pixel located in the first column and the first row is at the maximum level in the stored first image, the brightness of one pixel located in the first column and the first row is at the minimum level in the stored second image. Similarly, when the most-reload-image relates to the H-strip image, two H-strip images having the inversed strip patterns have are stored in the memory 151. For example, when the brightness of pixels of one specific row is at the maximum level, the brightness of pixels arranged in rows adjacent to the specific row is at the minimum level.

The detector 152 compares the data of the input image and the data of the most-reload-image stored in the memory 151, and then the detector 152 determines if the input image is the most-reload-image increasing the power consumption of the data driven circuit. Specifically, the gray scale values of each of the pixels in the input image are compared with the gray scale values of each of the pixels in the most-reload-image to obtain a gray level ratio for each of the pixels. Afterward, an average ratio is calculated by the obtained gray level ratios for each of the pixels. When the average ratio is larger than or equal to a default ratio, the input image is determined as the most-reload-image. When the average ratio is smaller than the default ratio, the input image is determined as a normal image. It can be understood that the default ratio is not larger than one. In addition, the default ratio is configured to be not smaller than 0.75 to avoid that most of the input images are erroneously determined as the most-reload-images.

In addition, when the most-reload-image is the dot on/off image, the data of the input image has to be respectively compared with the data of the two dot on/off images with inversed polarity to obtain two average ratios. The input image is determined as the most-reload-image if any one of the average ratios is not smaller than the default ratio. Similarly, when the most-reload-image is the H-strip image, the data of the input images has to be compared with that data of the two stored H-strip images to obtain two average ratios. The input image is determined as the most-reload-image if any one of the average ratios is not smaller than the default ratio.

The polarity controller 153 changes the polarity inversion method of the timing controller 12 according to a determination result of the detector 152. When the input image is the reload image, the polarity controller 153 changes the polarity inversion method of the timing controller 12, such as changing the dot inversion to the column inversion. On the other hand, when the input image is the normal image, not the reload image, the polarity controller 153 keeps the polarity inversion method of the timing controller 12 the same or changes the polarity inversion method back to the default one. For example, the polarity inversion method is still the dot inversion or the polarity inversion method is changed back to the dot inversion from the column inversion.

Figure 6:
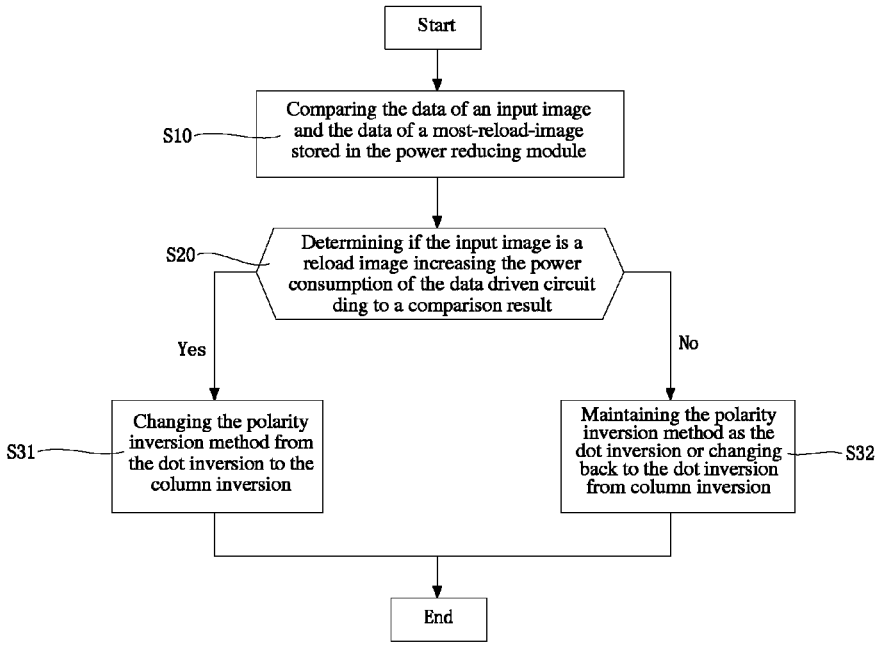
FIG. 6 is a flowchart showing the driving method of the LCD in accordance with one embodiment.

FIG. 6 is a flowchart showing the driving method of the LCD in accordance with one embodiment. The method includes the following steps.

In step S10, the data of the input images is compared with the data of the most-reload-image stored in the power reducing module.

In step S20, a determination is made regarding whether the input image is the reload image increasing the power consumption of the data driven circuit according to the comparison result.

If the input image is the reload image, in step S31, the polarity inversion method is changed from the dot inversion to the column inversion. If the input image is not the reload image, in step S32, the polarity inversion method of the timing controller is maintained as the dot inversion or is changed back to the dot inversion from column inversion.

In view of the above, by selectively changing the polarity inversion method of the timing controller basing on the input images, such as transiting from the dot inversion to the column inversion, the display performance is guaranteed and the power consumption of the data driven circuit is reduced at the same time.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal display (LCD), comprising:

a display panel comprising a plurality of data lines, a plurality of scanning lines intersecting with the data lines, and a matrix of pixels arranged in intersections of rows and columns;

a data driven circuit configured for providing data voltages to the data lines; and a power reducing module configured for storing a most-reload-image, comparing the data of the most-reload-image and the data of an input image, determining if the input image is a reload image increasing a power consumption of the data driven circuit according to a comparison result, and changing a polarity inversion method of a timing controller according to a determination result; and wherein the data of the input image comprises gray scale values of each of the pixels in the input image, the data of the most-reload-image comprises the gray scale values of each of the pixels in the most-reload-image, wherein the gray scale values of each of the pixels in the input image are compared with the gray scale values of each of the pixels in the most-reload-image to obtain a gray level ratio for each of the pixels.

2. The LCD as claimed in claim 1, wherein when the input image is the reload image, the power reducing module changes the polarity inversion method of the timing controller from a dot inversion to a column inversion, and when the input image is not the reload image, the polarity inversion method of the timing controller is maintained as the dot inversion or changed back to the dot inversion from the column inversion by the power reducing module.

3. The LCD as claimed in claim 2, wherein the power reducing module comprises:

a memory configured for storing the data of the most-reload-image;

a detector configured for comparing the data of the input image and the data of the most-reload-image stored in the memory and determines if the input image is the most-reload-image increasing the power consumption of the data driven circuit according to the comparison result; and a polarity controller configured for changing the polarity inversion method of the timing controller according to a determination result of the detector.

4. The LCD as claimed in claim 2, wherein when the display panel adopts one data line to provide a data voltage to one column of pixels, the most-reload-image is an all-white image or a dot on/off image.

5. The LCD as claimed in claim 2, wherein when the display panel adopts one data line to provide a data voltage to pixels arranged in two adjacent columns, the most-reload-image is an all-white image or a H-strip image.

6. The LCD as claimed in claim 2, wherein the data of the input image comprises gray scale values of each of the pixels in the input image, the data of the most-reload-image comprises the gray scale values of each of the pixels in the most-reload-image, wherein the gray scale values of each of the pixels in the input image are compared with the gray scale values of each of the pixels in the most-reload-image to obtain a gray level ratio for each of the pixels, and an average ratio is calculated by the obtained gray level ratios for each of the pixels, wherein when the average ratio is larger than or equal to a default ratio, the input image is determined as the reload-image, and when the average ratio is smaller than the default ratio, the input image is determined as a normal image.

7. The LCD as claimed in claim 6, wherein the default ratio is in a range between 0.75 and 1.

8. The LCD as claimed in claim 6, wherein when the display panel adopts one data line to provide a data voltage to one column of pixels and the most-reload-image is the dot on/off image, two dot on/off images with inversed polarity are stored in the power reducing module, the data of the input image has to be respectively compared with the data of the two dot on/off images with inversed polarity to obtain two average ratios, the input image is determined as the reload image if any one of the average ratios is not smaller than the default ratio, and wherein in the dot on/off images with inversed polarity, the brightness of one pixel in one of the dot on/off image is opposite to the brightness of the pixel with the same location in the other dot on/off image.

9. The LCD as claimed in claim 6, wherein when the display panel adopts one data line to provide a data voltage to pixels arranged in two adjacent columns and when the most-reload-image is the H-strip image, the data of the input image is respectively compared with two H-strip having inversed polarity to obtain two average ratios, the input image is determined as the reload image if any one of the average ratios is not smaller than the default ratio, and wherein in the two H-strip images with inversed polarity, the brightness of one pixel in one of the dot on/off image is opposite to the brightness of the pixel with the same location in the other dot on/off image.

10. The LCD as claimed in claim 1, wherein the power reducing module comprises:

a memory configured for storing the data of the most-reload-image;

a detector configured for comparing the data of the input image and the data of the most-reload-image stored in the memory and determines if the input image is the most-reload-image increasing the power consumption of the data driven circuit according to the comparison result; and a polarity controller configured for changing the polarity inversion method of the timing controller according to the determination result of the detector.

11. The LCD as claimed in claim 1, wherein when the display panel adopts one data line to provide a data voltage to one column of pixels, the most-reload-image is an all-white image or a dot on/off image.

12. The LCD as claimed in claim 1, wherein when the display panel adopts one data line to provide a data voltage to pixels arranged in two adjacent columns, the most-reload-image is an all-white image or a H-strip image.

13. The LCD as claimed in claim 1, wherein an average ratio is calculated by the obtained gray level ratios for each of the pixels, wherein when the average ratio is larger than or equal to a default ratio, the input image is determined as the reload image, and when the average ratio is smaller than the default ratio, the input image is determined as a normal image.

14. The LCD as claimed in claim 13, wherein the default ratio is in a range between 0.75 and 1.

15. The LCD as claimed in claim 13, wherein when the display panel adopts one data line to provide a data voltage to one column of pixels and the most-reload-image is the dot on/off image, two dot on/off images with inversed polarity are stored in the power reducing module, the data of the input image has to be respectively compared with the data of the two dot on/off images with inversed polarity to obtain two average ratios, the input image is determined as the reload image if any one of the average ratios is not smaller than the default ratio, and wherein in the dot on/off images with inversed polarity, the brightness of one pixel in one of the dot on/off image is opposite to the brightness of the pixel with the same location in the other dot on/off image.

16. The LCD as claimed in claim 13, wherein when the display panel adopts one data line to provide a data voltage to pixels arranged in two adjacent columns and when the most-reload-image is the H-strip image, the data of the input image is respectively compared with two H-strip having inversed polarity to obtain two average ratios, the input image is determined as the reload image if any one of the average ratios is not smaller than the default ratio, and wherein in the two H-strip images with inversed polarity, the brightness of one pixel in one of the dot on/off image is opposite to the brightness of the pixel with the same location in the other dot on/off image.

17. A driving method of a LCD, the LCD comprises a display panel and a data driven circuit configured for providing data voltages to the data lines, the display panel comprises a plurality of data lines, a plurality of scanning lines intersecting with the data lines, and a matrix of pixels arranged in intersections of rows and columns, the driving method comprising:

(a) comparing the data of an input image and the data of a most-reload-image stored in the power reducing module;

(b) determining if the input image is a reload image increasing the power consumption of the data driven circuit according to a comparison result; and (c) changing a polarity inversion method of the timing controller according to a determination result; and wherein the data of the input image comprises gray scale values of each of the pixels in the input image, the data of the most-reload-image comprises the gray scale values of each of the pixels in the most-reload-image, wherein the gray scale values of each of the pixels in the input image are compared with the gray scale values of each of the pixels in the most-reload-image to obtain a gray level ratio for each of the pixels.

* * * * *